US005248995A

United States Patent [19]

Izumi

[11] Patent Number: 5,248,995

[45] Date of Patent: Sep. 28, 1993

[54] HEAT CONTROL METHOD OF A THERMAL HEAD

[75] Inventor: Hiroshi Izumi, Morioka, Japan

[73] Assignee: Alps Electric Co., Ltd., Tokyo, Japan

[21] Appl. No.: 840,432

[22] Filed: Feb. 24, 1992

[30] Foreign Application Priority Data

Feb. 25, 1991 [JP] Japan ..... 3-30268

[51] Int. Cl.[5] ..... B41J 2/32

[52] U.S. Cl. ..... 346/76 PH

[58] Field of Search ..... 346/76 PH; 400/120

[56] References Cited

U.S. PATENT DOCUMENTS 4,590,484 5/1986 Matsuhita ..... 346/76 PH
4,638,329 1/1987 Nakayama et al. ..... 346/76 PH
4,875,056 10/1989 Ono ..... 400/120

*Primary Examiner*—Benjamin R. Fuller
*Assistant Examiner*—Huan Tran
*Attorney, Agent, or Firm*—Guy W. Shoup; Patrick T. Bever

[57] ABSTRACT

There is provided a heat control method of a thermal head which can achieve even printing of high quality by conducting area control so that heating elements of the thermal head may not be uneven in print density in the arrangement direction, and more particularly, which controls the heat amount of a thermal head having a plurality of heating elements arranged in a row on a substrate by controlling the current supply time of the heating elements of the thermal head, divides the heating elements into a plurality of control groups a in the direction of the row, sets virtual control groups on both ends of the row, and controls the heat amount of the thermal head by performing control so as to level the differences in temperature among the control groups.

8 Claims, 6 Drawing Sheets

Fig. 5

| COUNT VALUE | RANK VALUE R |
|---|---|
| 0 ~ 199 | 1 |
| 200 ~ 399 | 2 |
| 400 ~ 599 | 3 |
| ⋮ | ⋮ |
| 6200 ~ 6399 | 32 |

Fig. 6

| RANK VALUE R | SUBTRACTION VALUE X |
|---|---|
| 1 ~ 3 | 0 |
| 4 ~ 6 | 2 |
| 7 ~ 9 | 4 |
| 10 ~ 11 | 6 |
| 12 | 8 |
| 13 | 10 |
| 14 | 14 |
| 15 ~ 32 | 16 |

Fig. 7

| Non VALUE | ADDITIONAL VALUE Z |
|---|---|
| 0 | 0 |
| 1 | 3 |
| 2 | 6 |
| 3 | 9 |
| 4 | 12 |
| 5 | 15 |
| 6 | 16 |
| 7 | 16 |
| 8 | 16 |

Fig. 8

| K VALUE | ADJUSTMENT VALUE Y |
|---|---|
| -64 ~ -31 | -16 |
| -30 ~ -29 | -15 |
| -28 ~ -27 | -14 |
| -26 ~ -25 | -13 |
| ⋮ | ⋮ |
| -2 ~ -1 | -1 |
| 0 | 0 |
| 1 ~ 2 | 1 |
| 3 ~ 4 | 2 |
| ⋮ | ⋮ |
| 25 ~ 26 | 13 |
| 27 ~ 28 | 14 |
| 29 ~ 30 | 15 |
| 31 ~ 64 | 16 |

HEAT CONTROL METHOD OF A THERMAL HEAD

BACKGROUND OF THE INVENTION

1. Field of the Invention

The present invention relates to a heat control method of a thermal head which achieves even printing by controlling the heating state of the thermal head used in printing.

2. Description of the Related Art

A typical thermal head is formed by arranging a plurality of heating elements in one or more rows on a substrate made of, for example, a semiconductor or ceramics, and the heating elements are selectively supplied with electricity to generate heat for printing according to printing information.

According to the construction of such a thermal head, since the temperature of the heating elements and the substrate rises in printing, the current supply time of the heating elements is controlled in consideration of the temperature rise to prevent uneven printing.

In order to control the current supply time, a past data control method and an area control method are conventionally used.

The past data control method controls the current supply time in accordance with the past current supply states of a heating element to be supplied with current and peripheral heating elements.

On the other hand, since the temperature of the substrate gradually rises due to the current supplied to the heating elements, the print density at the beginning of a line becomes different from that at the end of the line. The area control method controls the current supply time so as to eliminate the difference.

However, since the conventional area control method does not appropriately cope with an actual temperature rise of the substrate, it cannot completely prevent print density from being uneven.

More specifically, the conventional area control method finds the total number of heating elements in a line which previously have been supplied with electricity, and adjusts, in accordance with the total number, the degree to which the current supply time for printing of the next line is shortened. Therefore, when the total number is large, the current supply time for the next line is shortened to a great extent.

However, since all the heating elements are uniformly controlled, the same area control is conducted on both heating elements in the upper and lower portions and heating elements in the center in the arrangement direction of the heating elements. As a result, the print density of the upper and lower portions, where heat is apt to escape, is lower than that of other portions.

SUMMARY OF THE INVENTION

An object of the present invention is to provide a heat control method of a thermal head which can perform even printing of high quality by conducting area control so as to eliminate differences in density in the arrangement direction of heating elements.

In order to achieve the above object, in a heat control method of a thermal head having a plurality of heating elements arranged in a row on a substrate which controls the heat amount of the thermal head by controlling the current supply time of the heating elements, a plurality of control groups are formed by dividing the heating elements in the arrangement direction, virtual control groups are set on both ends of the row, and the heat amount is controlled by performing a control operation to level the differences in temperature among the control groups.

According to the present invention, area control is not uniformly conducted on heating elements, the heating elements are divided into a plurality of control groups in the arrangement direction, virtual control groups are set on both ends of a row of the heating elements, and control to level the differences in temperature among the control groups is executed. Therefore, excellent printing can be performed without making print density uneven in the arrangement direction of the heating elements.

BRIEF DESCRIPTION OF THE DRAWINGS

FIG. 5 is a count value-rank value correspondence table of the present invention;

FIG. 6 is a rank value-subtraction value correspondence table of the present invention;

FIG. 7 is a Non value-additional value correspondence table of the present invention; and FIG. 8 is a K value-adjustment value correspondence table of the present invention.

DETAILED DESCRIPTION OF THE PREFERRED EMBODIMENT

A preferred embodiment of the present invention will now be described with reference to FIGS. 1 to 8.

FIGS. 1 to 8 show an embodiment of the present invention. In this embodiment, a thermal head in which 128 heating elements are arranged in a row is to be controlled.

Figure 1:
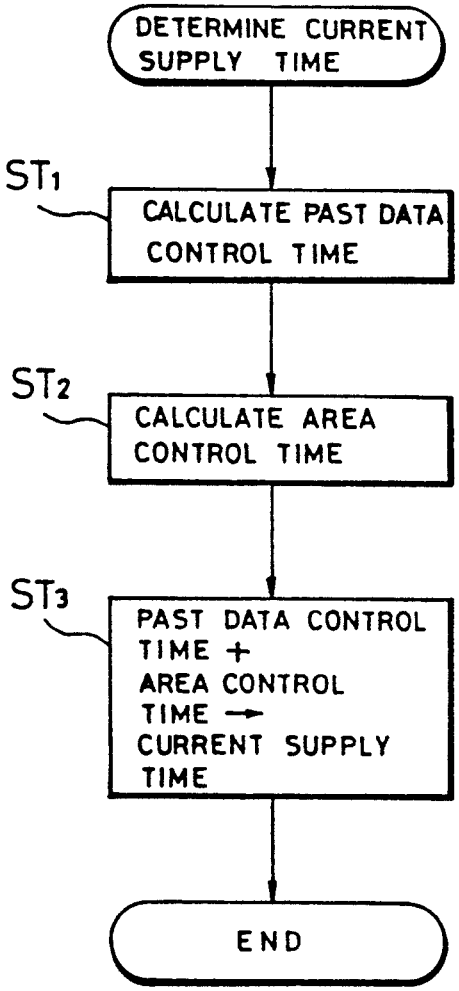
FIG. 1 is a flow chart explaining a typical heat control method of a thermal head.

FIG. 1 is a flow chart showing the process to determine the current supply time to the heating element of the thermal head to which the present invention is partially applied. Past data control times of all the heating elements are calculated in Step $St_1$, area control times of all the heating elements are calculated in Step $St_2$, and the past data control times and the area control times are added in Step $St_3$, thereby finding the current supply time of the heating elements.

The past data control is performed in the same manner as before.

On the other hand, the area control is performed according to the embodiment shown in FIGS. 2 to 8.

Figure 2:
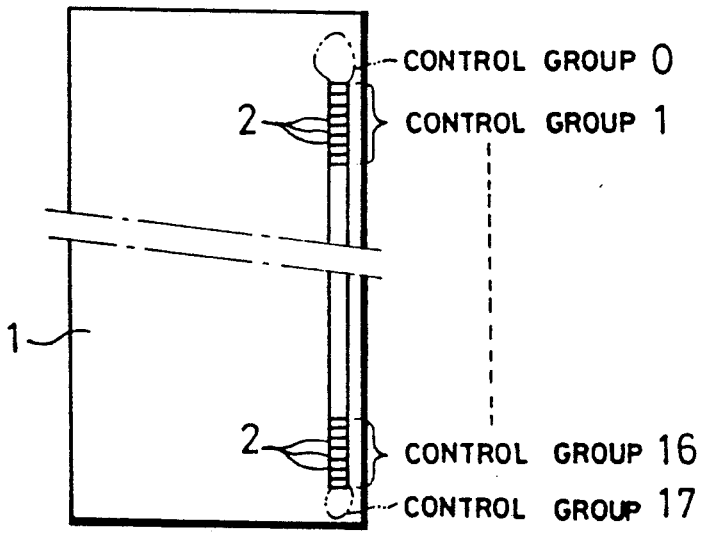
FIG. 2 is a plan view of a thermal head to which the method of the present invention is applied.

In this embodiment, as shown in FIG. 2, 128 heating elements 2, 2 , . . . which are arranged in a row on a substrate 1 are divided into control groups 1, 2, 3 , . . . 15 and 16 from top each of which groups is composed of eight heating elements, and virtual control groups 0 and 17 are set next to the heating elements 2 and 2 on the top and at the bottom of the row, respectively. Hereinafter, if an unspecified control group is described, the control group is referred to as a "control group a".

Figure 3:
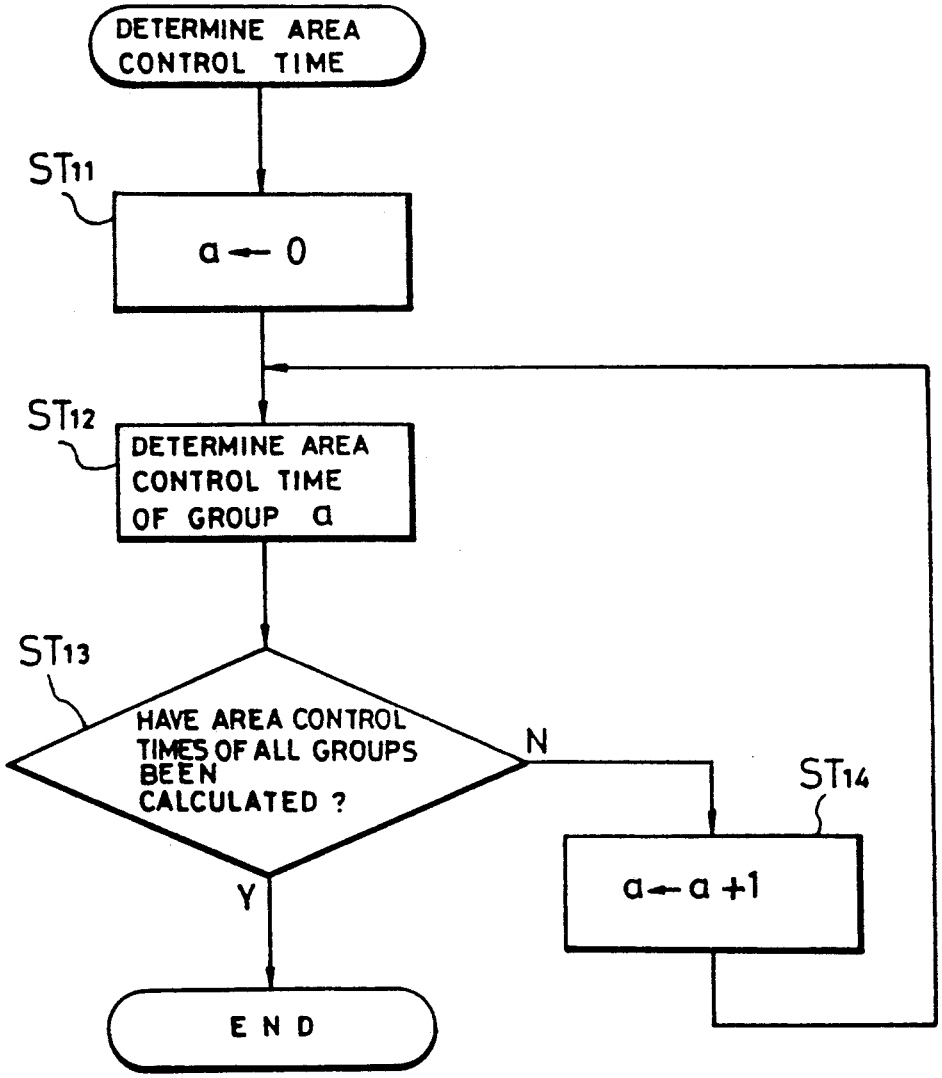
FIG. 3 is a schematic flow chart showing the case in which area control is performed according to the present invention.
Figure 4:
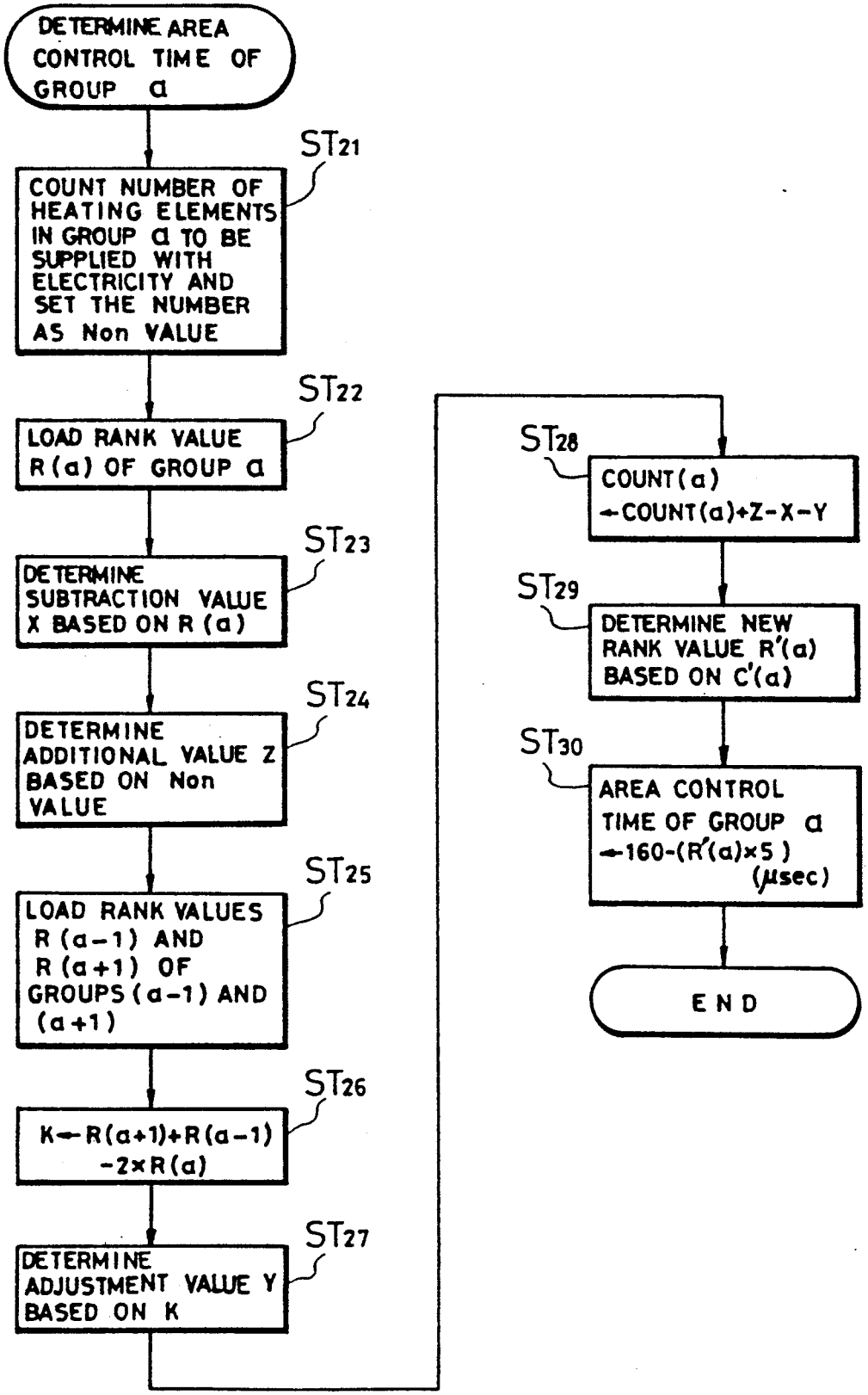
FIG. 4 is a flow chart showing area control according to a first embodiment of the present invention.

The area control time is determined with respect to the above 18 control groups as shown in FIGS. 3 and 4.

In Step $St_{11}$ of FIG. 3, "a" of the control group a is changed into 0. Then, calculation is performed to determine a control time of the control group a in $Step_{12}$. The calculation is carried out as shown in FIG. 4. In Step $St_{13}$, it is checked whether or not the calculation in Step $St_{12}$ is conducted on all the control groups. If the calculation is completed, the process is terminated. If the calculation is not completed, "a" of the control group a is changed into a+1 in Step $St_{14}$, and the same calculation is repeated in Step $St_{12}$.

The method of determining the area control time of the control group a will be described with reference to FIG. 4.

In Step $St_{21}$, the number of heating elements of the eight heating element in the control group a to be supplied with electricity in the present cycle is found based on print information and set as a Non value.

In Step $St_{22}$, a rank value R(a) of the control group a is found according to a count value-rank value correspondence table shown in FIG. 5. In FIG. 5, the count value means the total number of heating elements supplied with electricity in printing for one previous line among the eight heating elements. Therefore, the rank value R is found according to the correspondence table shown in FIG. 5 after the count value is calculated.

In Step $St_{23}$, a subtraction value X is determined based on the rank value R(a) according to a rank value-subtraction value correspondence table shown in FIG. 6. The subtraction value X is a factor for compensating the fall of temperature of the substrate 1. Since the temperature of the substrate 1 is high and the heating amount is large when the rank value R is large, the subtraction value X is determined so as to extend the current supply time of the heating elements 2.

In Step $St_{24}$, an additional value Z is determined based on the Non value according to a Non value-additional value correspondence table shown in FIG. 7. The additional value Z is a factor for restraining the temperature of the substrate 1 from exceeding a predetermined value due to the current supply to the heating elements 2. As the Non value increases, the additional value Z also increases. In this embodiment, when the Non value is 6, 7 or 8, the additional value Z is set at 16, that is, the rise rate of the additional value Z is made smaller than the rise rate when the Non value changes from 0 to 5 for the following reason. Since the past data control is conducted on the current supply time of the heating elements to a great extent when the Non value is large and thereby the past data control has been performed to restrain the rise of the temperature of the substrate 1, it is preferable for the actual temperature control of the substrate 1 that the control performed by the additional value Z to restrain the temperature rise of the substrate be restricted.

Rank values R(a−1) and R(a+1) of control groups (a−1) and (a+1) are found in Step $St_{25}$, and a K value is calculated in Step $St_{26}$ according to the following expression:

$$K=R(a+1)+R(a-1)-2R(a) \quad (1)$$

Then, an adjustment value Y is determined base on the K value according to a K value-adjustment value correspondence table shown in FIG. 8.

The differences in temperature among the control groups are levelled by the operations in Steps $St_{25}$ to $St_{27}$. Therefore, the adjustment value Y is a factor for shortening and extending the current supply time of the heating elements 2. In other words, when the rank values R(a+1) and R(a−1) of the control groups (a+1) and (a−1) next to the control group a are larger than the rank value R(a) of the control group a, the adjustment value Y is positive, and when there is a big difference between the rank values, it is large. To the contrary, when the rank values R(a+1) and R(a−1) of the control groups (a+1) and (a−1) are smaller than the rank value R(a) of the control group a, the adjustment value Y is negative, and an absolute value of the adjustment value Y is large when there is a big difference between the rank values. A rank value of each of the control groups 0 and 17 on the top and at the bottom of the row is set at 1.

In Step $St_{28}$, a new count value C'(a) is calculated according to the following expression:

$$C'(a)=C(a)+Z-X+Y \quad (2)$$

C(a) is the same as the count value serving as a base of finding the rank value R(a) in Step $St_{22}$.

In Step $St_{29}$, a new rank value R'(a) is determined based on the new count value C'(a) according to the count value-rank value correspondence table shown in FIG. 5.

Then, in Step $St_{30}$, an area control time t(a) of the control group a is calculated according to the following expression:

$$t(a)=160-5R'(a)\ 10^3\ (\mu sec) \quad (3)$$

As described above, the area control time t(a) can be found by subtracting a control value 5R' from a predetermined maximum current supply time 160(μsec).

According to the present embodiment described above, the 128 heating elements 2 are divided into 16 control groups 1, 2, 3, . . . 15 and 16 in the arrangement direction without being uniformly controlled as before, the virtual control groups 0 and 17 are set on both ends of a row of the heating elements 2, and control is conducted on each control group a so as to level the difference in temperature between the control groups. Therefore, it is possible to achieve excellent printing which makes no difference in print density between the heating elements in the direction of the row. In particular, since the control is similarly conducted on the virtual control groups 0 and 17, print densities on both ends of the row of the heating elements 2 are the same, and thus high-quality printing can be performed.

The present invention is not limited to the above embodiment, and various changes and/or modifications thereof can be made as necessity requires.

As described above, according to the heat control method of a thermal head of the present invention, area control is not uniformly performed with respect to heating elements, the heating elements are divided into a plurality of control groups in the arrangement direction, and virtual control groups are set on both ends of a row of the heating elements, thereby conducting control on each control group to level the differences in temperature among the control groups. Therefore, the area control can be performed without making any difference in print density in the arrangement direction of the heating elements, and thus excellent printing can be performed.

What is claimed is:

1. A heat control method for a thermal head for controlling the temperature of said thermal head by controlling the duration for which the current is supplied to a plurality of heating elements arranged in a row on a substrate of said thermal head, said method comprising the steps of:

dividing said heating elements into a plurality of control groups;

setting virtual control groups on both ends of the row;

performing a control operation to level differences in temperature among said control groups.

2. A heat control method according to claim 1, wherein said method of controlling the temperature further includes the steps of: adding a past data control time and an area control time and determining the duration for which current is supplied to each of said heating elements.

3. A heat control method according to claim 2, wherein a plurality of said heating elements are to be supplied with electricity in a present current supply cycle, said method further comprising: determining said area control time based on the number of said heating elements to be supplied with electricity in said present current supply cycle.

4. An area control time calculating method for a thermal head comprised of a plurality of heating elements divided into a plurality of control groups, wherein a plurality of said heating elements are to be supplied with electricity in a present current supply cycle, said method comprising the steps of:

(a) calculating the number of said heating elements in a first control groups to be supplied with electricity in said present current supply cycle, and setting said number as a Non value;

(b) determining a control factor of the area control based on said Non value;

(c) determining a control time based on said control factor;

(d) finding an area control time t(a) by subtracting said control time from a predetermined maximum current supply time; and (e) repeating steps (a)–(d) for each of the remaining control groups.

5. A heat control method according to claim 1, wherein a plurality of said heating elements in said one of said plurality of control groups are to be supplied with electricity in a present currently supply cycle, said method further comprising the steps of:

(a) determining a past data control time based on a previous current supply state of said heating elements to be supplied with electricity;

(b) finding the number of said heating elements in said one of said control groups to be supplied with electricity in said present current supply cycle, and setting said Number as a Non value;

(c) determining a control factor for area control based on said Non value;

(d) determining an area control time based on said control factor; and (e) finding a control time by adding said past data control time and said area control time, and determining a current supply time of said heating elements based on said control time.

6. A method for controlling the temperature of a thermal head having a plurality of serially disposed heating elements, each of said plurality of heating elements generating heat in direct proportion to an amount of current supplied to the heating element, said method comprising the steps of:

dividing said heating elements into a plurality of serially disposed groups; and controlling a first amount of current supplied to one of said plurality of control groups in response to a second amount of current supplied to an adjacent one of said plurality of control groups such that a temperature differences between said plurality of control groups is minimized.

7. A method according to claim 6 wherein said step of controlling further comprises determining said first amount of current in response to said second amount of current supplied to first adjacent one of said plurality of control groups, and further in response to a third amount of energy supplied by a second adjacent one of said plurality of control groups, said one of said plurality of control groups being disposed between said first and second adjacent ones of said plurality of control groups.

8. A method according to claim 6 wherein said plurality of serially disposed control groups includes two end groups, and said method further comprises the step of:

calculating a virtual control value equivalent to a control group having inactivated heating elements; and wherein said step of controlling said first amount of current supplied to each of said end control groups further comprises determining said first amount of current in response to said second amount of current supplied to said adjacent ones of said plurality of control groups, and further in response to said virtual control value.

* * * * *